US009353591B2

(12) United States Patent
Johal et al.

(10) Patent No.: US 9,353,591 B2
(45) Date of Patent: May 31, 2016

(54) SELF-DRAINING PRODUCTION ASSEMBLY

(71) Applicant: Cameron International Corporation, Houston, TX (US)

(72) Inventors: Kashmir Singh Johal, Middlesex (GB); Guy Mosscrop, Cypress, TX (US)

(73) Assignee: OneSubsea IP UK Limited, London (GB)

( * ) Notice: Subject to any disclaimer, the term of this patent is extended or adjusted under 35 U.S.C. 154(b) by 350 days.

(21) Appl. No.: 13/943,902

(22) Filed: Jul. 17, 2013

(65) Prior Publication Data

US 2015/0021040 A1 Jan. 22, 2015

(51) Int. Cl.
*E21B 33/035* (2006.01)
*E21B 33/076* (2006.01)

(52) U.S. Cl.
CPC ..... *E21B 33/035* (2013.01); *E21B 33/076* (2013.01)

(58) Field of Classification Search
CPC ..... E21B 33/035; E21B 33/076
USPC ..... 166/368
See application file for complete search history.

(56) References Cited

U.S. PATENT DOCUMENTS 3,139,932 A * 7/1964 Johnson ..... E21B 23/002 137/112
3,331,437 A * 7/1967 Jones ..... E21B 33/076 166/340
5,535,826 A * 7/1996 Brown ..... E21B 34/04 166/244.1
5,992,527 A * 11/1999 Garnham ..... E21B 34/04 166/379
6,244,348 B1 6/2001 Gariepy et al.
6,494,257 B2 * 12/2002 Bartlett ..... B24B 37/04 166/348
7,025,133 B2 * 4/2006 McIntosh ..... E21B 34/16 166/348
8,066,063 B2 * 11/2011 Donald ..... C22B 3/02 166/368
8,430,169 B2 4/2013 Stoisits et al.
8,613,323 B2 * 12/2013 Garbett ..... E21B 33/038 166/338
2002/0179300 A1 12/2002 Gay et al.
2003/0019632 A1 * 1/2003 Humphrey ..... E21B 33/035 166/368
2004/0112604 A1 * 6/2004 Milberger ..... E21B 33/043 166/368
2005/0121198 A1 * 6/2005 Andrews ..... E21B 33/043 166/368
2007/0289747 A1 12/2007 Shaw et al.
2008/0128139 A1 6/2008 White
2009/0294131 A1 * 12/2009 Lewis ..... E21B 33/035 166/368
2012/0048567 A1 * 3/2012 June ..... E21B 33/035 166/368
2013/0000918 A1 * 1/2013 Voss ..... E21B 34/04 166/344

FOREIGN PATENT DOCUMENTS

WO 2006031335 A1 3/2006

OTHER PUBLICATIONS

International Search Report and Written Opinion dated Oct. 29, 2014, issued in corresponding PCT application No. PCT/US2014/046443, filed Jul. 11, 2014, 12 pgs.

* cited by examiner

*Primary Examiner* — Matthew R Buck
(74) *Attorney, Agent, or Firm* — Chamberlain Hrdlicka

(57) ABSTRACT

A production assembly includes a tree body, in which the tree body includes a main production bore formed about an axis and a wing bore extending through the tree body from the main production bore. The tree body may further include a wing valve in fluid communication with the wing bore to control the flow of fluid through the wing bore, in which at least a portion of the wing bore is angled from perpendicular with respect to the axis of the main production bore.

20 Claims, 5 Drawing Sheets

SELF-DRAINING PRODUCTION ASSEMBLY

BACKGROUND

Over the last thirty years, the search for oil and gas offshore has moved into progressively deeper waters. Wells are now commonly drilled at depths of several hundreds, to even several thousands, of feet below the surface of the ocean. In addition, wells are now being drilled in more remote offshore locations.

In cold water production environments, such as found in these remote offshore locations, the management of hydrates in subsea equipment is important. Those of ordinary skill in the art will understand that hydrates may form within subsea wellheads, production equipment, risers, and elsewhere, in which hydrates restrict the flow of production fluids. Hydrates are crystals formed by water in contact with natural gases and associated liquids, which typically occurs in a ratio of 85 mole % water to 15% hydrocarbons. Hydrates can form when hydrocarbons and water are present at the right temperature and pressure, such as in wells, flow lines, or valves. The hydrocarbons become encaged in ice-like solids that do not flow, but which rapidly grow and agglomerate to sizes that can block production fluid passages and flow lines. Hydrate formation most typically occurs in subsea production equipment that is at relatively low temperatures and elevated pressures.

To manage this hydrate formation, operators may insulate the subsea production equipment, an expensive, difficult, and time-consuming process. For example, a production tree, normally installed subsea to control production fluids from oil and gas reservoirs, has a complex shape that makes it difficult to apply insulation. Further, some areas of the production tree are not available for insulation at all, as these areas of the production tree must remain accessible for manual re-entry and/or connection to the production tree and wellhead.

In addition, the operator may inject chemical "inhibitors" at or near the subsea wellhead, such as into the manifold. Gas hydrates may be thermodynamically suppressed by adding materials such as salts or glycols, which operate as "antifreeze." Commonly, methanol or methyl ethylene glycol (MEG) may be injected at the subsea tree as the antifreeze material. Inhibitors are oftentimes introduced during well startup. The inhibitor will continue to be injected until the subsea equipment is sufficiently warmed by the produced fluids such that the risk of hydrate formation is abated.

The management of hydrates becomes more difficult when production is shut-in, whether planned or unplanned. For instance, the production of a well or a well-site may be shutdown, such as the result of an emergency at the well-site, host facilities platform, or vessel. An operator may not have time to inject an inhibitor so as to "inhibit" produced fluids resident in a production passage or line, and the lack of having any production fluids flowing through equipment may allow the equipment to cool down. This may result in the production equipment experiencing even cooler temperatures during a shut-in. As such, hydrate formation remains a priority to increase the efficiency of subsea production equipment.

BRIEF DESCRIPTION OF THE DRAWINGS

For a detailed description of the preferred embodiments of the invention, reference will now be made to the accompanying drawings in which.

DETAILED DESCRIPTION

Figure 1:
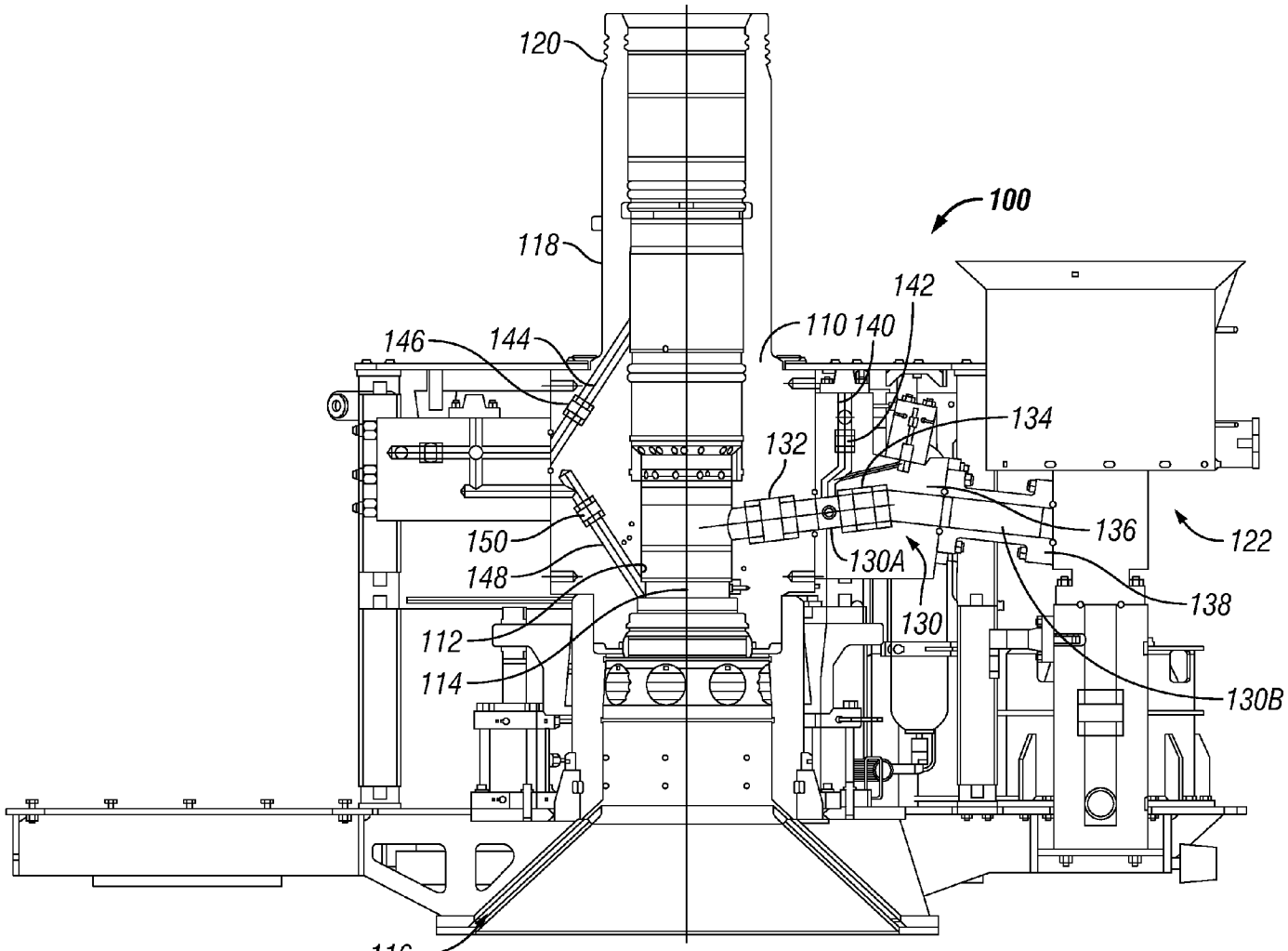
FIG. 1 shows a production assembly including a production tree in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Accordingly, disclosed herein is a production assembly for a well that includes a production tree. The production assembly may be subsea, and may include any type of production tree known in the art, such as conventional (e.g., vertical), dual bore, mono bore, TFL (through flow line), horizontal, mudline, mudline horizontal, side valve, and/or TBT (through bore tree) trees.

Referring now to FIG. 1, a production assembly 100 in accordance with one or more embodiments of the present disclosure is shown. The production assembly 100 includes a production tree 110 with a main production bore 112 formed therethrough about an axis 114. In this embodiment, the production tree 110 is shown as a subsea horizontal production tree, though the production tree 110 may be any type of production tree known in the art. As such, the production assembly 100 may include a conical guide 116, which in use is used to guide and mount the production tree 110 onto a wellhead. The production assembly 100 may include a re-entry hub 118, such as formed with or mounted to the production tree 110, in which an upper end 120 of the re-entry hub 118 may be used to connect other production components thereto, such as a blowout preventer (BOP) or the like.

As mentioned, the production tree 110 includes a main production bore 112 formed about the axis 114, in which the main production bore 112 may extend substantially vertically through the production tree 110 (discussed more below). Further, the production assembly 100 includes a wing bore 130, in which the wing bore 130 may be formed within the production tree 110 and extend outward from the main production bore 112. As such, the wing bore 130 and the main production bore 112 are in fluid communication with each other such that fluids produced from a wellhead and into the production tree 110 may be received into the main production bore 112 and through the wing bore 130.

Further, a production choke assembly 122, which may be of conventional design, may then be connected to the production outlet of the production tree 110, such as connected to the wing bore 130 of the production tree 110. The production choke assembly 122 may be used to control a rate and/or pressure of the flow of fluid received therethrough. Accordingly, fluid produced into the production system 100 may be received into the main production bore 112, through the wing bore 130, and then through the production choke assembly 122.

In accordance with one or more embodiments of the present disclosure, the production assembly 100 may include one or more valves to selectively control fluid flow through the production assembly 100. Accordingly, one or more wing valves may be included within and in fluid communication with the wing bore 130 to control fluid flow therethrough. For example, as shown in FIG. 1, the wing bore 130 may include a primary or production master valve 132 and a secondary or production wing valve 134, in which one or both of the primary valve 132 and the secondary valve 134 may be used to control fluid flow through the wing bore 130.

Still referring to FIG. 1, the wing bore 130 in the production assembly 100 may have at least a portion that is angled from perpendicular with respect to the axis 114 of the main production bore 112. For example, if the wing bore 130 was arranged to be perpendicular with respect to the axis 114 of the main production bore 112, the wing bore 130 would be oriented and extend in a direction at an angle of 90 degrees with respect to the axis 114 of the main production bore 112. However, as mentioned above, at least a portion of the wing bore 130 is angled from perpendicular with respect to the axis 114 of the main production bore 112. As such, at least a portion of the wing bore 130 may be arranged at an angle from a line or plane that is perpendicular with respect to the axis 114 of the main production bore 112.

In particular, in accordance with one or more embodiments of the present disclosure, the wing bore 130 may include more than one portion that is angled from perpendicular with respect to the axis 114 of the main production bore 112. For example, the wing bore 130 may include an internal wing bore portion 130A and an external wing bore portion 130B. As shown particularly in FIG. 1, the internal wing bore portion 130A may be on one side of the secondary valve 134, the side closer to the main production bore 112, and the external wing bore portion 130B may be on the other side of the secondary valve 134, the side farther away from the main production bore 112. As such, the internal wing bore portion 130A and/or the external wing bore portion 130B may be angled from perpendicular with respect to the axis 114 of the main production bore 112.

In accordance with one or more embodiments of the present disclosure, the internal wing bore portion 130A may be angled with respect to the external wing bore portion 130B. Thus, as shown in FIG. 1, the internal wing bore portion 130A may be angled towards the main production bore 112, in that fluid under no influence of pressure would flow from the internal wing bore portion 130A towards the main production bore 112. Further, the external wing bore portion 130B may be angled away from the main production bore 112, in that fluid under no influence of pressure would flow from the external wing bore portion 130B away from the main production bore 112, such as towards the production choke assembly 122.

In accordance with one or more embodiments of the present disclosure, the wing bore 130 in the production assembly 100 may have at least a portion that is angled between about 5 degrees to about 10 degrees from perpendicular with respect to the axis 114 of the main production bore 112. In particular, in one or more embodiments, the wing bore 130 in the production assembly 100 may have at least a portion that is angled between about 6 degrees to about 7 degrees from perpendicular with respect to the axis 114 of the main production bore 112. For example, with respect to FIG. 1, the internal wing bore portion 130A may be angled between about 5 degrees to about 10 degrees, and more particularly between about 6 degrees to about 7 degrees, from perpendicular towards the axis 114 of the main production bore 112. Further, the external wing bore portion 130B may be angled between about 5 degrees to about 10 degrees, and more particularly between about 6 degrees to about 7 degrees, from perpendicular away from the axis 114 of the main production bore 112.

As shown and discussed above, the production assembly 100 and the production tree 110 may include the wing bore 130, in which the wing bore 130 may include one or more portions, such as the internal wing bore portion 130A and the external wing bore portion 130B. The wing bore 130 may further include one or more valves, such as the primary valve 132 and the secondary valve 134. As such, one or more of these components may be formed separately from or integrally with the body of the production tree 110.

For example, as shown in FIG. 1, a wing valve block 136 may be used to house the secondary valve 134 and a portion of the wing bore 130. The wing valve block 136 may be connected to the exterior of the production tree 110 such that fluids produced from a wellhead and into the production tree 110 may be received into the main production bore 112 and through the wing bore 130. Further, a wing bore block 138 may additionally or alternatively be used to house a portion of the wing bore 130. The wing bore block 138 may be connected to the exterior of the wing valve block 136 such that fluid produced into the production system 100 may be received into the main production bore 112, through the wing bore 130, and then through the production choke assembly 122. As such, those having ordinary skill in the art will appreciate that the wing valve block 136 and/or the wing bore block 138 may be formed separately from the body of the production tree 110, as shown in FIG. 1, and/or may be formed integrally with the body of the production tree 110. Accordingly, the present disclosure contemplates other embodiments, arrangements, and configurations, other than those shown, without departing from the scope of the present disclosure.

Referring still to FIG. 1, the production assembly 100 and the production tree 110 may include one or more bores and/or one or more valves in addition to those discussed above without departing from the scope of the present disclosure. For example, the production tree 110 may include a cross-over bore 140 with a cross-over valve 142, in which the cross-over bore 140 may be in fluid communication with the wing bore 130 with the cross-over valve 142 controlling fluid flow through the cross-over bore 140. Further, the production tree 110 may include an annulus flow path, such as may include an upper bore 144 with a upper valve 146 in fluid communication with the main production bore 112 above the intersection with the wing bore 130 and/or may include a lower bore 148 with a lower valve 150 in fluid communication with the main production bore 112 below the intersection with the wing bore 130. Accordingly, as similar to above, one or more these bores and/or one or more these valves may be formed separately from or integrally with the body of the production tree 110 in accordance with one or more embodiments of the present disclosure.

As discussed above, the production tree 110 may be connected to or mounted upon a wellhead such that fluids produced from a wellhead may be received may be received into the main production bore 112 and through the wing bore 130 of the production tree 110. Accordingly, in one or more embodiments, the present disclosure may be used to facilitate the drainage of fluids within the production tree 110 and the production assembly 100, such as by the wing bore 130 including at least a portion that is angled from perpendicular with respect to the axis 114 of the main production bore 112. For example, when in normal operation, production fluid may flow from the wellhead, into the main production bore 112, and into and out through the wing bore 130. However, when not in normal operation, such as during an emergency and/or a well shut-in, fluid may no longer be produced into the production assembly 100 under pressure, in which fluid may be trapped or contained, at least temporarily, within the production tree 110 and the production assembly 100. As such, with at least a portion of the wing bore 130 angled with respect to the axis 114 of the main production bore 112, fluid may then drain and flow from out of the wing bore 130 and into adjacent flow paths, such as flow into the main production bore 112 and/or the production choke assembly 122.

For example, in the embodiment shown in FIG. 1, the internal wing bore portion 130A may be used to have fluid drain into the main production bore 112, as the internal wing bore portion 130A may be angled towards the axis 114 of the main production bore 112. Further, the external wing bore portion 130B may be used to have fluid drain away from the main production bore 112, such as into the production choke assembly 122, as the external wing bore portion 130B may be angled away from the axis 114 of the main production bore 112.

Accordingly, when production has ceased, such as during a shut-in, fluid contained in the portions of the wing bore 130 angled towards the main production bore 112, such as the internal wing bore portion 130A, may drain into the main production bore 112, and portions of the wing bore 130 angled away from the main production bore 112, such as the external wing bore portion 130B, may drain away from the main production bore 112 and into the production choke assembly 122. Such an arrangement may be used to prevent hydrate formation within undesired portions or locations of the production tree 110 and the production assembly 100. For example, during a shut-in, when the production tree 110 and the production assembly 100 may be most susceptible to the formation of hydrates therein, fluid contained within the production tree 110 and the production assembly 100, such as within the wing bore 130, may be drained out of the wing bore 130 and into the nearby flow paths and conduits, such as into the main production bore 112 and/or into the production choke assembly 122. When fluid drains into the main production bore 112, in one or more embodiments some or all of this fluid may drain back into the well through the wellhead, in which temperatures may remain relatively higher from the surrounding mass of the wellbore such that hydrates are not able to form. Further, when fluid drains into the production choke assembly 122, in one or more embodiments some or all of this fluid may then drain into a pipe flow loop in fluid communication with the production choke assembly 122. The pipe flow loop may then be used to prevent hydrate formation therein, such as through insulation, as the geometry of a pipe flow loop enables easier application of insulation thereto as compared to a production tree.

In addition to have a self-draining feature in accordance with one or more embodiments of the present disclosure, a chemical inhibitor may be introduced into the production tree 110 and the production assembly 100 to help prevent the formation of hydrates therein. For example, a chemical inhibitor may be injected into the production tree 110, such as into and through the cross-over bore 140, the upper bore 144, and/or the lower bore 148. This may enable the chemical inhibitor to be strategically injected within the production tree 110 and the production assembly 100 to prevent hydrate formation therein and/or facilitate fluid flow therethrough.

Further, a chemical inhibitor to facilitate the prevention of hydrate formation may be introduced into the wing bore 130, such as from the cross-over bore 140 into selected portions of the wing bore 130. For example, in one or more embodiments, a chemical inhibitor may be introduced in the portions of the wing bore 130 angled towards the main production bore 112, such as the internal wing bore portion 130A, to drain into the main production bore 112, and/or may be introduced in the portions of the wing bore 130 angled away from the main production bore 112, such as the external wing bore portion 130B, to drain away from the main production bore 112 and into the production choke assembly 122 and/or a pipe flow loop in fluid communication with the production choke assembly 122. Such an arrangement may additionally or alternatively be used to prevent hydrate formation within undesired portions or locations of the production tree 110 and the production assembly 100.

As discussed above, the production tree 110 shown in FIG. 1 is a subsea horizontal production tree, though any type of production tree known in the art. Accordingly, referring now to FIGS. 2A-2C, a production tree 210 of a production assembly 200 in accordance with one or more embodiments of the present disclosure is shown, in which the production tree 210 may be a conventional (e.g., vertical) production tree. The production tree 210 may include a main production bore 212 formed therethrough with a wing bore 230 intersecting with and extending from the main production bore 212. The wing bore 230 may include an internal wing bore portion 230A and an external wing bore portion 230B, and may also include one or more valves in fluid communication therewith, such as a primary valve 232 and a secondary valve 234. A wing valve block 236 may also be included to house the secondary valve 234 and a portion of the wing bore 230, in which the wing valve block 236 may be formed separately from the production tree 210, as shown particularly in FIG. 2A, or may be formed integrally with the production tree 210, as shown particularly in FIG. 2B.

Further, as discussed above, the wing bore 230 in the production assembly 200 may have at least a portion that is angled from perpendicular with respect to the main production bore 212. As such, in one or more embodiments, only a portion of the wing bore 230 may be angled from perpendicular with respect to the main production bore 212. For example, as shown in FIG. 2C, a portion of the wing bore 230 is angled from perpendicular with respect to the main production bore 212, such as the portion of the wing bore 230 included in the wing valve block 236, while the remainder of the wing bore 230 remains perpendicular with respect to the main production bore 212.

Figure 2A:
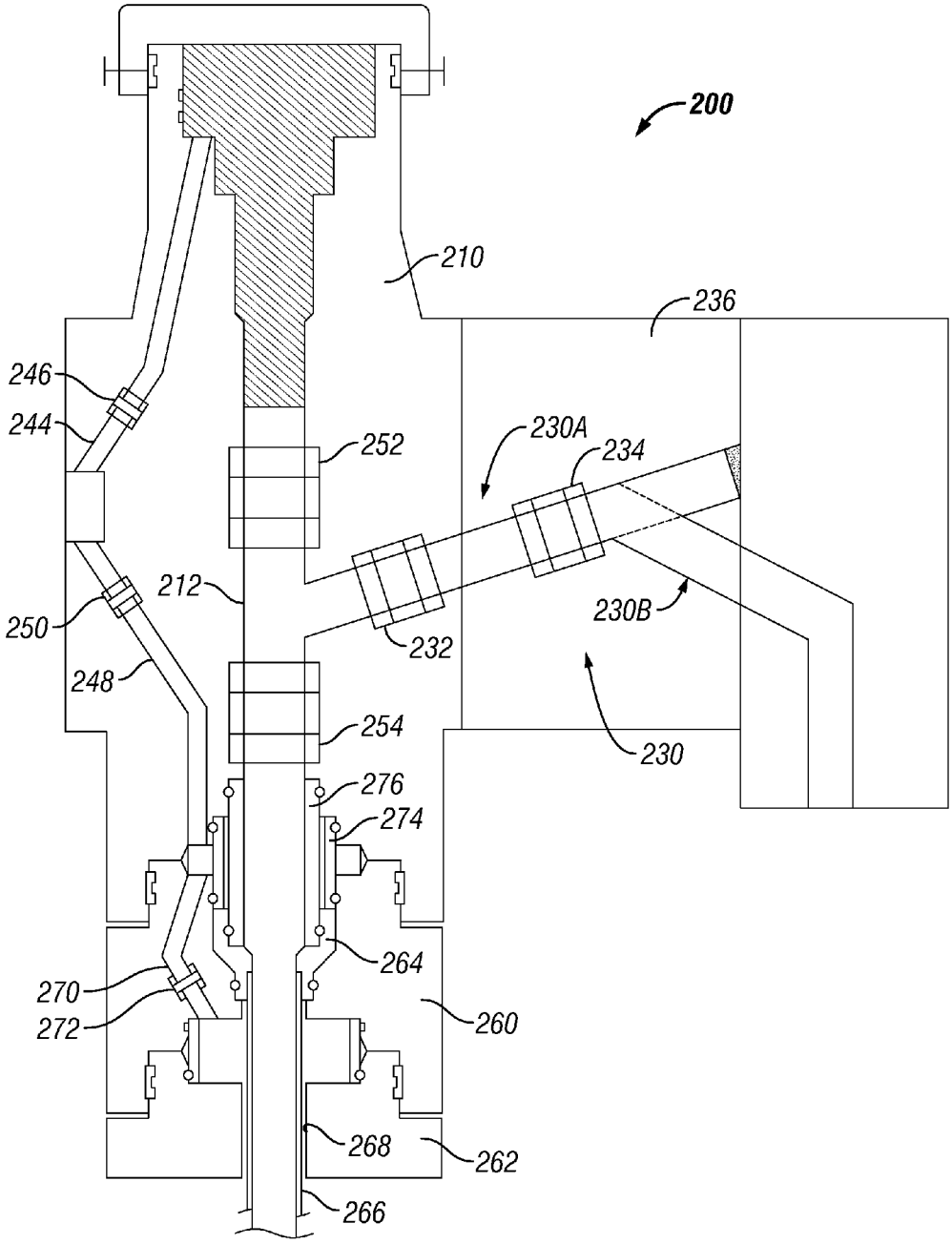
FIG. 2A shows a production assembly including a production tree in accordance with one or more embodiments of the present disclosure.
Figure 2B:
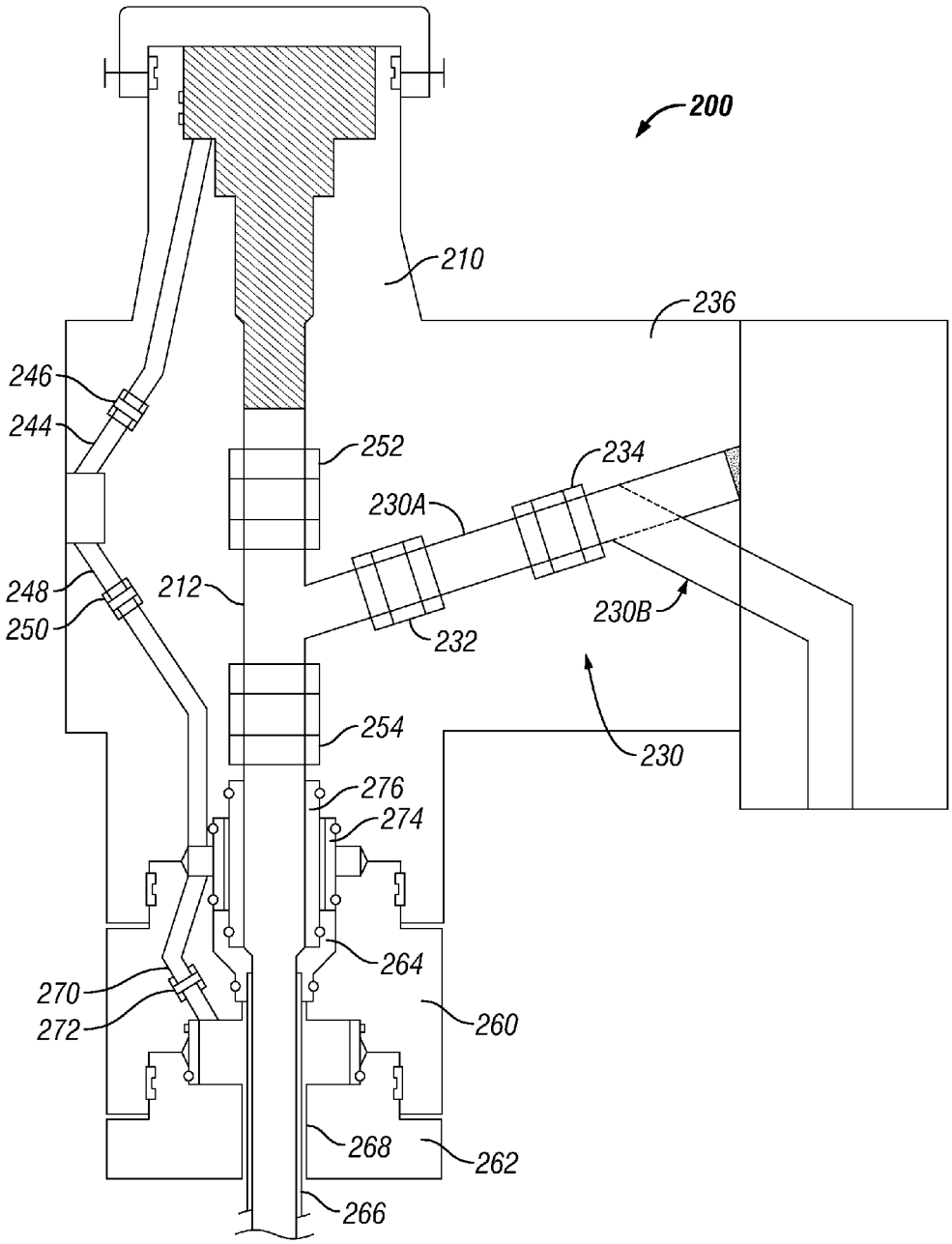
FIG. 2B shows a production assembly including a production tree in accordance with one or more embodiments of the present disclosure.
Figure 2C:
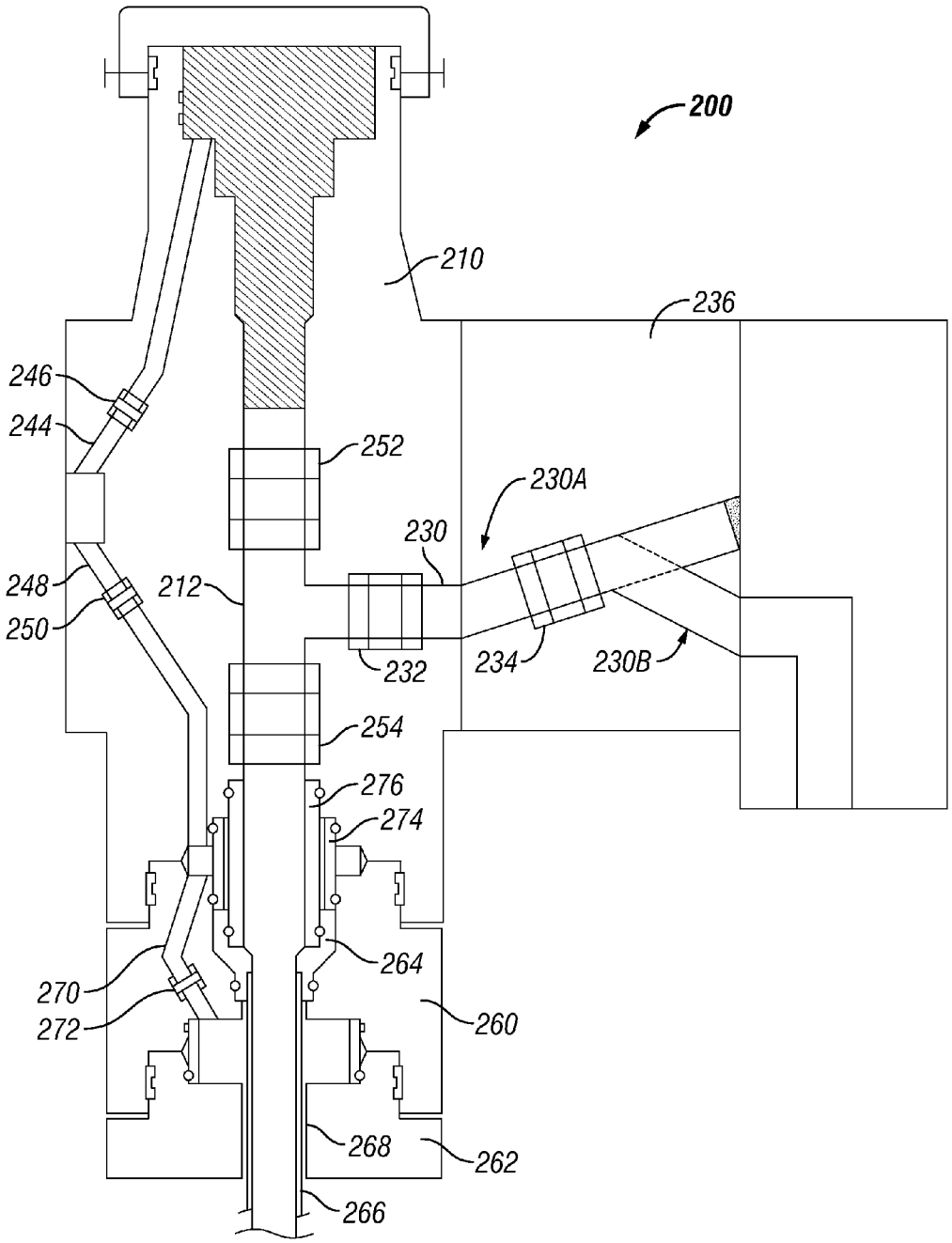
FIG. 2C shows a production assembly including a production tree in accordance with one or more embodiments of the present disclosure.

Referring still to FIGS. 2A-2C, the production tree 210 may include an annulus flow path, such as an upper bore 244 with a upper valve 246 in fluid communication with the main production bore 212 above the intersection with the wing bore 230 and/or a lower bore 248 with a lower valve 250 in fluid communication with the main production bore 212 below the intersection with the wing bore 230. Further, the production tree 210 may include a production swab valve 252 and/or a production master valve 254 in fluid communication with the main production bore 212. For example, the production swab valve 252 may be included within the main production bore 212 above the intersection of the main production bore 212 and the wing bore 230, and the production master valve 254 may be included within the main production bore 212 below the intersection of the main production bore 212 and the wing bore 230.

The production tree 210 may be connected to a tubing head spool 260, such as mounted on the top of the tubing head spool 260, and the tubing head spool 260 may be connected to a wellhead 262, such as mounted on the top of the wellhead 262. A tubing hanger 264 with a production bore may be landed in the tubing head spool 260 below the production tree 210, in which the tubing hanger 264 may support production tubing 266 extending into and through a production bore 268 of the wellhead 262. Production casing (not shown) may also surround the production tubing 266 and extend into the well below the wellhead 262, creating an annular area between the production tubing 266 and the production casing.

Further, in the embodiments shown in FIG. 2A-2C, the tubing head spool 260 and/or the production tree 210 may include an annulus bypass bore 270 with an annular bypass valve 272 such that the annular area surrounding the production tubing 266 may be in fluid communication with the production tree 210 above the tubing hanger 264. As the production tree 210 may be installed on top of the tubing head spool 260, a tree isolation sleeve 274 may be used to isolate the annulus bore from the main production bore 212, such as to allow for pressure testing within the production system 200 while isolating the tubing hanger 264 from the test pressure. The top of the tree isolation sleeve 274 seals against the production tree 210 and the bottom of the isolation sleeve 274 seals against the tubing head spool 260. A production stab 276 may then be used to provide primary and secondary sealing mechanisms, such as to isolate the main production bore 212 from the annulus bore. As such, the top of the production stab 276 may seal against the production tree 210, and the bottom of the production stab 276 may seal against the tubing hanger 264. Alternatively, the production tree 210 may be installed directly to a wellhead 262.

As shown and discussed above, a production system in accordance with the present disclosure may include a production tree attached to the top of a wellhead, either directly or indirectly. As such, a wellhead in accordance with the present disclosure may have a production bore formed therethrough that may be aligned and in fluid communication with a main production bore of a production tree. In one or more embodiments, when installing the wellhead within a well, it is desired to have an axis of the production bore of the wellhead substantially vertical, such as with respect to the sea floor. However, at times, though the production bore may be substantially vertical, the axis of the wellhead production bore may be oriented slightly off from directly vertical, such as by having the axis of the wellhead production bore angled by about 5 degrees in either direction (e.g., left or right) from directly vertical.

Accordingly, because the axis of the wellhead production bore may angled up to about 5 degrees from directly vertical, a wing bore of a production assembly in accordance with one or more embodiments of the present disclosure may have at least a portion that is angled by at least about 5 degrees from perpendicular with respect to an axis of a main production bore of a production tree and/or with respect to the axis of the wellhead production bore. Such an arrangement may enable fluid within the wing bore to still properly drain out of the production tree, even in a scenario in which the axis of the wellhead production bore is angled up to about 5 degrees from directly vertical. Thus, in one or more embodiments of the present disclosure, a wing bore of a production assembly may have at least a portion that is angled between about 5 degrees to about 10 degrees, and more particularly between about 6 degrees to about 7 degrees, from perpendicular with respect to the axis of the main production bore of the production tree.

As shown and discussed above, a production assembly in accordance with the present disclosure may include one or more valves, such as one or more valves within the wing bore of the production tree and/or one or more valves within the main production bore of the production tree. As such, a valve in accordance with the present disclosure may be any type of valve known in the art, such as a gate valve, a ball valve, a globe valve, a needle valve, and/or any other type of valve known in the art. Further, in addition to the bores and valves shown above with reference to the production assembly, additional bores and valves may be included within the production assembly without departing from the scope of the present disclosure.

One having ordinary skill in the art will appreciate that a valve in accordance with the present disclosure may include a cavity therein, such as a gate valve that includes a cavity to receive the gate of the gate valve. As such, a valve may include enough space formed therein such that, under proper conditions, hydrates may be able to form within the cavities of the valve. In accordance with one or more embodiments, one or more packers or spacers may be inserted into these cavities to prevent hydrate formation therein. Further, small apertures, such as two three-eighth inch (9.525 mm) holes, may be formed within the wall of the gate, in which the apertures may allow fluid to be drained out of the valve through the apertures. For example, the small apertures may be drilled from an outer edge and into the gate through the bore of the valve to allow fluid to drain therethrough. Additionally or alternatively, a small fluid trap may be included or formed within the valve, such as at the bottom of the valve, in which a small volume of fluid may be allowed to congregate therein away from any moving parts of the valve. As such, the present disclosure contemplates multiple embodiments and configurations for valves to prevent the formation of hydrates therein.

Figure 2D:
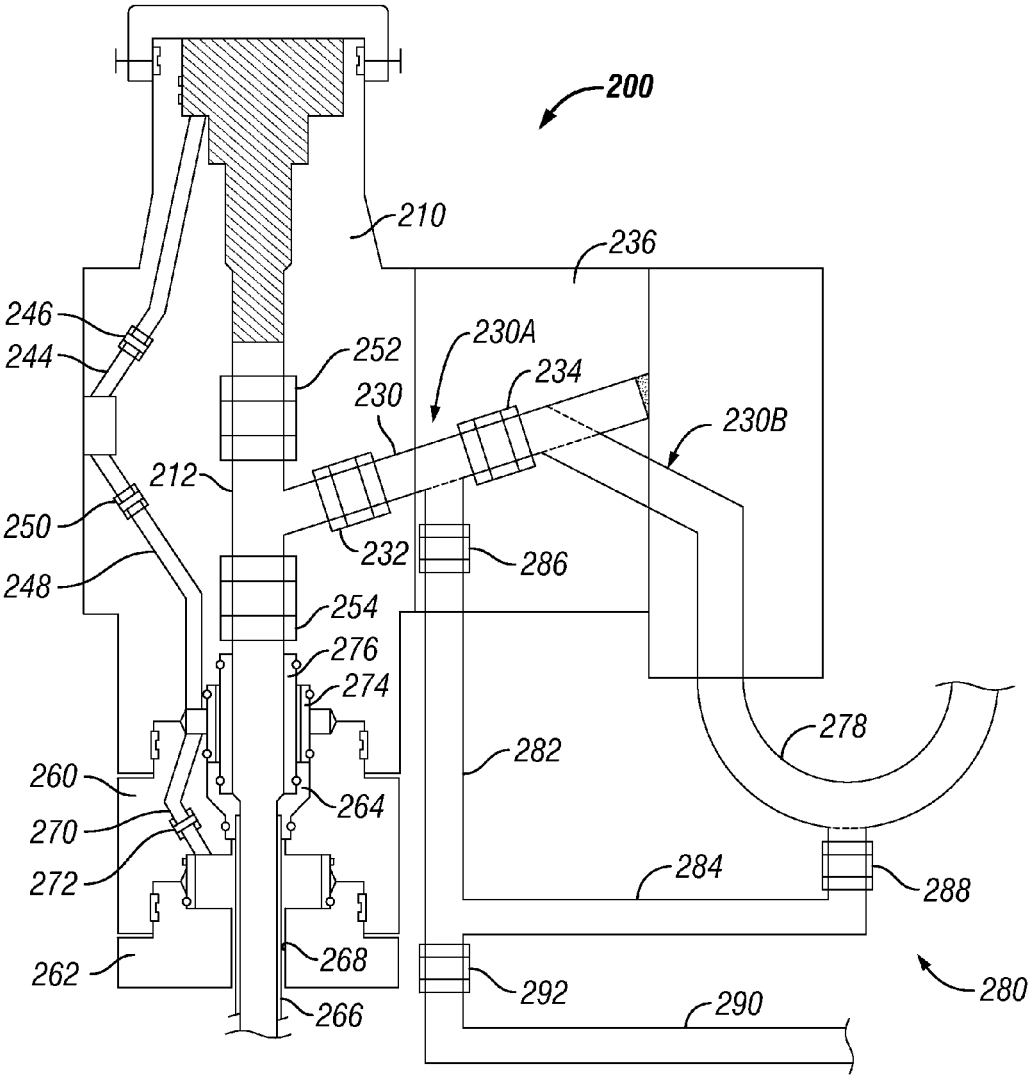
FIG. 2D shows a production assembly including a production tree in accordance with one or more embodiments of the present disclosure.

Further, a production assembly in accordance with one or more embodiments of the present disclosure may include a drainage system to facilitate draining of the production fluids and prevention of hydrate formation within the production assembly. For example, as shown in FIG. 2D, the production assembly 200 may include a drainage system 280 included within and/or in fluid communication with the production tree 210. The production tree 210 may include a bore 278 formed therein and/or fluidly coupled thereto, in which the bore 278 may be used to fluidly couple the production tree 210 to other production components and/or assemblies. For example, the bore 278 may be used to have fluids produced into and through the production tree 210 using the main production bore 212 and the wing bore 230 in fluid communication with a connector that receives the produced fluids. As such, during a shut-in or an emergency shutdown, fluid within the internal wing bore portion 230A may flow and drain away from the secondary valve 234 towards the main production bore 212, and fluid within the external wing bore portion 230B may flow and drain away from the secondary valve 234 towards the bore 278. The drainage system 280 may facilitate drainage of these production fluids, and may also facilitate hydrate formation within the production assembly 200, such as when a chemical inhibitor is introduced into the production assembly 200 to prevent hydrate formation therein and within other components fluidly coupled thereto.

The drainage system 280 may include an internal drainage bore 282 and an external drainage bore 284. The internal drainage bore 282 may include an internal drainage valve 286 in fluid communication therewith, such as to enable and prevent fluid flow through the internal drainage bore 282. The internal drainage bore 282 may be fluidly coupled to the internal wing bore portion 230A of the wing bore 230 such that fluid draining away from the secondary valve 234 and towards the main production bore 212 may drain into the internal drainage bore 282. The external drainage bore 284 may include an external drainage valve 288 in fluid communication therewith, such as to enable and prevent fluid flow through the external drainage bore 284. The internal drainage bore 284 may be fluidly coupled to the external wing bore portion 230B of the wing bore 230 such that fluid draining away from the secondary valve 234 and towards the bore 278 may drain into the external drainage bore 284. In one or more embodiments, the external drainage bore 284 may fluidly couple to the bore 278 at a lowest part thereof, as shown particularly in FIG. 2D, to facilitate drainage into the drainage system 280.

The drainage system 280 may further include a collection drainage bore 290 having a collection drainage valve 292 in fluid communication with the internal drainage bore 282 and the external drainage bore 284. As such, as the internal drainage bore 282 and the external drainage bore 284 intersect with each other to form the collection drainage bore 290, fluid that drains into the internal drainage bore 282 and the external drainage bore 284 may collect and then drain into the collection drainage bore 290.

In one or more embodiments, fluid contained within the production assembly 200 may then drain into the drainage system 280. For example, fluid from the internal wing bore portion 230A may then drain into the drainage system 280 through the internal drainage bore 282, and/or fluid from the external wing bore portion 230B may drain into the drainage system 280 through the external drainage bore 284.

Accordingly, a chemical inhibitor to facilitate the prevention of hydrate formation, such as methanol, may be introduced into the wing bore 230 of the production assembly 200. For example, in one or more embodiments, a chemical inhibitor may be introduced or injected into the internal wing bore portion 230A, in which the chemical inhibitor may then drain into the drainage system 280 through the internal drainage bore 282. The chemical inhibitor may additionally or alternatively be introduced or injected into the external wing bore portion 230B, in which the chemical inhibitor may then drain into the drainage system 280 through the external drainage bore 284. Such an arrangement and/or configuration may enable the present disclosure to facilitate the prevention of hydrate formation, in addition to limiting or preventing the use of insulation altogether with respect to the production assembly. For example, as shown in FIG. 2D, insulation may not even be necessary for the bore 278, as the bore 278 may drain into the drainage system 280 and/or may have a chemical inhibitor introduced therein to prevent hydrate formation therein.

During a shut-in or an emergency shutdown, it may be common to have every valve within a production assembly automatically close to prevent any flow of fluid within or through the production assembly. However, in accordance with one or more embodiments of the present disclosure, one or more valves of a drainage system may be opened after a shut-in or shutdown to prevent the formation of hydrates therein. For example, with reference to FIG. 2D, the external drainage valve 288 may be opened to enable fluid flow between the external drainage bore 284 and the bore 278. In particular, in one embodiment, after closure of all valves during a shut-in or shutdown, the external drainage valve 288 may be opened to enable fluid flow therethrough, in which fluid may flow from the external drainage bore 284 and into the bore 278 due to pressure being greater within the external drainage bore 284 than the main production bore 212 and the wing bore 230. In such an embodiment, a chemical inhibitor may be included within and/or introduced into the drainage system 280, such as within the external drainage bore 284, in which the chemical inhibitor may then flow into other areas of the production system 200, such as within the bore 278, to prevent hydrate formation therein.

Although the present invention has been described with respect to specific details, it is not intended that such details should be regarded as limitations on the scope of the invention, except to the extent that they are included in the accompanying claims.

What is claimed is:

1. A production assembly, comprising:

a main production bore formed about an axis;

a wing bore extending from the main production bore;

a wing valve in fluid communication with the wing bore to control the flow of fluid through the wing bore; and wherein the wing bore comprises an internal wing bore portion and an external wing bore portion, the internal wing bore portion being closer to the main production bore than the external wing bore portion, the internal wing bore portion being angled upward from perpendicular with respect to the axis of the main production bore, and the external wing bore portion being angled downward from perpendicular with respect to the axis of the main production bore.

2. The production assembly of claim 1, wherein the internal wing bore portion is on one side of the wing valve and the external wing bore portion is on another side of the wing valve.

3. The production assembly of claim 1, wherein the internal wing bore portion is angled upward between about 5 degrees to about 10 degrees from perpendicular to the main production bore axis, and the external wing bore portion is angled downward between about 5 degrees to about 10 degrees from perpendicular away from the main production bore axis.

4. The production assembly of claim 1, wherein the internal wing bore portion is angled upward between about 6 degrees to about 7 degrees from perpendicular to the main production bore axis, and the external wing bore portion is angled downward between about 6 degrees to about 7 degrees from perpendicular away from the main production bore axis.

5. The production assembly of claim 1, wherein the wing valve comprises a primary valve and a secondary valve to control the flow of fluid through the wing bore.

6. The production assembly of claim 1, further comprising a tree body comprising one of a horizontal tree body and a vertical tree body, the tree body further comprising the main production bore and the wing bore.

7. The production assembly of claim 6, further comprising a wing valve block including the wing valve and at least one of the internal wing bore portion and the external wing bore portion.

8. The production assembly of claim 7, wherein the wing valve block is one of formed separately from the tree body and formed integrally with the tree body.

9. The production assembly of claim 1, wherein, in operation, production fluid flows up into the main production bore and out the wing bore.

10. The production assembly of claim 9, wherein when the wing valve is closed, production fluid will flow away from both sides of the wing valve, even if the axis of the main production bore is not directly vertical.

11. The production assembly of claim 1, further comprising a drainage system in fluid communication with the wing bore, the drainage system including an internal drainage bore and an external drainage bore.

12. A subsea production assembly, comprising:

a wellhead comprising a wellhead housing with a production bore formed therein; and a production tree attachable to a top of the wellhead housing, the production tree comprising:

a main production bore formed about an axis and configured to be aligned and in fluid communication with the production bore of the wellhead housing;

a wing bore extending from the main production bore;

a wing valve configured to be in fluid communication with the wing bore and to control fluid flow through the wing bore; and wherein the wing bore comprises an internal wing bore portion and an external wing bore portion, the internal wing bore portion being closer to the main production bore than the external wing bore portion, the internal wing bore portion being angled upward from perpendicular to the main production bore axis, and the external wing bore portion being angled downward from perpendicular to the main production bore axis.

13. The subsea production assembly of claim 12, wherein the internal wing bore portion is on one side of the wing valve and the external wing bore portion is on another side of the wing valve.

14. The subsea production assembly of claim 12, wherein the internal wing bore portion is angled upward between about 6 degrees to about 7 degrees from perpendicular with respect to the axis of the main production bore, and the external wing bore portion is angled downward between about 6 degrees to about 7 degrees from perpendicular away from the main production bore axis.

15. The subsea production assembly of claim 12, wherein the wing valve comprises a primary valve and a secondary valve to control the flow of fluid through the wing bore.

16. The subsea production assembly of claim 12, further comprising a wing valve block including the wing valve and at least one of the internal wing bore portion and the external wing bore portion.

17. The subsea production assembly of claim 12, wherein, when the wing valve is closed, production fluid will flow away from both sides of the wing valve, even if the axis of the main production bore is not directly vertical.

18. A production assembly for a subsea well, comprising:

a main production bore formed about an axis;

a wing bore extending from the main production bore; and a wing valve in fluid communication with the wing bore to control the flow of fluid through the wing bore;

wherein the wing bore comprises an internal wing bore portion and an external wing bore portion, the internal wing bore portion being closer to the main production bore than the external wing bore portion, the internal wing bore portion being angled upward from perpendicular with respect to the axis of the main production bore, and the external wing bore portion being angled downward from perpendicular with respect to the axis of the main production bore; and wherein the wing valve is configured such that when it is closed, fluid will flow away from the wing valve even if the axis of the main production bore is not directly vertical.

19. A method of producing a fluid from a well, comprising:

flowing the fluid through a main production bore of a production assembly;

flowing the fluid through a wing bore extending from the main production bore, wherein flowing the fluid further comprises:

flowing the fluid through an internal portion of the wing bore at an angle upward from perpendicular with respect to an axis of the main production bore; and flowing the fluid through an external portion of the wing bore at an angle downward from perpendicular with respect to the axis of the main production bore, the internal wing bore portion being closer to the main production bore than the external wing bore portion; and controlling the flow of the fluid through the wing bore using a control valve in fluid communication with the wing bore.

20. The method of claim 19, wherein:

the flowing the fluid through the internal portion of the wing bore comprises flowing the fluid at an upward angle between about 5 degrees to about 10 degrees from perpendicular with respect to the axis of the main production bore; and the flowing the fluid through the external portion of the wing bore comprises flowing the fluid at a downward angle between about 5 degrees to about 10 degrees from perpendicular with respect to the axis of the main production bore.

* * * * *